US005298706A

United States Patent [19]

English et al.

[11] Patent Number: 5,298,706

[45] Date of Patent: Mar. 29, 1994

[54] MEMBRANE COMPUTER KEYBOARD AND IMPROVED KEY STRUCTURE

[75] Inventors: George P. English, Coeur d'Alene, Id.; Stephen S. Damitio, Veradale, Wash.

[73] Assignee: Key Tronic Corporation, Spokane, Wash.

[21] Appl. No.: 929,723

[22] Filed: Aug. 13, 1992

[51] Int. Cl.[5] ..... H01H 1/10

[52] U.S. Cl. ..... 200/517; 200/5 A; 200/520; 200/534

[58] Field of Search ..... 200/5 R, 5 A, 512, 513, 200/517, 520, 521, 534, 242, 293, 329, 341, 345

[56] References Cited

U.S. PATENT DOCUMENTS

| | | | |
|---|---|---|---|
| 4,088,855 | 5/1978 | Emery | 200/5 A X |
| 4,489,227 | 12/1984 | Lamarche | 200/314 |
| 4,540,865 | 9/1985 | Calder | 200/5 A X |
| 4,560,844 | 12/1985 | Takamura et al. | 200/5 |
| 4,677,268 | 6/1987 | Nemeth et al. | 200/159 |
| 4,760,217 | 7/1988 | Suzuki et al. | 200/5 |
| 4,814,561 | 3/1989 | Kawasaki | 200/517 |
| 4,827,243 | 5/1989 | Cheng | 341/22 |
| 4,876,415 | 10/1989 | Clancy | 200/5 |
| 5,034,573 | 6/1991 | Bonmassari et al. | 200/5 |
| 5,115,106 | 5/1992 | Weiland et al. | 200/517 |

FOREIGN PATENT DOCUMENTS

| | | | |
|---|---|---|---|
| 4-92321 | 3/1992 | Japan | 200/341 |

OTHER PUBLICATIONS

Johnson, Keyboard and Wiping Contact Assembly, IBM Technical Disclosure Bulletin, vol. 13 No. 7 Dec. 1970.

*Primary Examiner*—Glenn T. Barrett
*Attorney, Agent, or Firm*—Wells, St. John, Roberts, Gregory & Matkin

[57] ABSTRACT

A computer keyboard employs a single monoblock structure to both support the keys and to define the aesthetic enclosure. The monoblock has multiple key supports into which key bodies are slidably mounted. The keyboard includes a switch membrane disposed on top of the monoblock and a dome sheet positioned on top of the switch membrane beneath the key bodies. The dome sheet has multiple resilient domes with openings formed therein to provide access for the key bodies to corresponding key supports. The domes support the key bodies and provide the "spring-like" feel during operation of the computer keys. The switch membrane has annular switch contacts positioned about the monoblock key supports beneath the domes. As one of the key bodies is depressed, the associated dome buckles and actuates the annular switch contact. The computer keyboard is low cost due to having only one structural component and is quiet due to the position of the rubber or elastomer dome sheet beneath the key bodies.

14 Claims, 9 Drawing Sheets

MEMBRANE COMPUTER KEYBOARD AND IMPROVED KEY STRUCTURE

TECHNICAL FIELD

This invention relates to computer keyboards and individual key structures within computer keyboards.

BACKGROUND OF THE INVENTION

As the computer keyboard industry matures, there is an increasing drive among keyboard manufacturers to produce lower cost keyboards. Traditionally, manufacturers have produced a keyboard 10 such as that shown in FIG. 1. One such prior art computer keyboard is disclosed in U.S. Pat. No. 4,560,844 granted to Takamura on Dec. 24, 1985.

Keyboard 10 includes multiple keys 12 mounted in a housing 14, which includes a rigid metal backing plate 16, a rigid metal or plastic mounting plate 18, and a rigid plastic enclosure 20. Keyboard 10 also has a switch membrane 22 and a dome sheet 24 positioned between backing plate 16 and mounting plate 18.

Mounting plate 18 has multiple key supports 26 into which keys 12 are slidably mounted so that keys 12 can be moved from rest positions to activated positions.

Switch membrane 22 comprises multiple switch contacts positioned beneath respective keys 12. The switch contacts are actuated upon depression of these keys. Dome sheet 24 comprises multiple resilient domes 28 which project upward to bias keys 12 to their rest position. Domes 28 collapse when keys 12 are depressed and rebound to their original form when keys 12 are released by the user to provide the "spring-like" feel of the computer keys. When the keys are depressed, switch membrane 22 generates an electric signal from an actuated switch contact to an electrical circuit, such as microprocessor, which is also provided on keyboard 10, but not shown in this figure.

Backing plate 16 provides the support for mounting plate 18, switch membrane 22, and dome sheet 24.

The prior art keyboard of FIG. 1 has a drawback in that it is relatively costly to produce. Housing 14 requires three structural components: (1) backing plate 16, (2) mounting plate 18, and (3) enclosure 20. These three housing components contribute significantly to the overall keyboard cost. Additionally, assembly time is greater because employees or machines must handle and assemble multiple separate housing components during the construction of a single keyboard.

Recognizing this, keyboard manufacturers have attempted to reduce the number of components employed in their computer keyboards. For example, U.S. Pat. No. 4,876,415 granted to Clancy on Oct. 24, 1989 combines a portion of the keyboard enclosure with the backing plate to eliminate one structural layer of the housing. U.S. Pat. No. 4,760,217 granted to Suzuki on Jul. 26, 1988 proposes a similar structure in that a back portion of the enclosure also functions as the backing plate for the computer keyboard. However, both of these patents still require a mounting plate to support the keys in addition to the combination enclosure/backing plate.

Prior art keyboards have another disadvantage in that they are noisy to operate. When a computer key is depressed, the plastic key cap typically strikes the plastic or metal mounting plate. This plastic-to-plastic contact causes a "clicking" sound which is tolerable, but undesired.

A separate problem associated with conventional keyboards concerns switch contact designs. One prior art switch contact 30 is illustrated in FIGS. 2A and 2B. Switch contact 30 is formed in switch membrane 32, which includes an upper flexible layer 34, a spacer layer 36, and a lower, rigid or flexible layer 38. A first conductive pad 40 is provided on upper layer 34 and a second conductive pad 42 is provided on lower layer 38 to face first conductive pad 40. Spacer layer 36 separates conductive pads 40 and 42 to provide an insulative air gap therebetween. Conductive pads 40 and 42 thereby constitute switch contact 30.

When a transverse force F is applied to upper flexible layer 34 at switch contact 30 (FIG. 2B), first conductive pad 40 is brought into electrical contact with second conductive pad 42. Upper flexible layer 34 is deformed into a concave shape as shown and electrical contact between first and second conductive pads 40 and 42 is made at a single point 44.

The conventional switch contact of FIGS. 2A and 2B have an inherent drawback in that electrical contact is made initially only at a single point 44. Additional transverse force is often required to effectuate more surface contact between first and second conductive pads 40 and 42. This additional force is undesired because it contributes to user fatigue over a prolonged period of keyboard operation. A second drawback to this prior art switch contact is that foreign debris or particles may become lodged on conductive pads 40 and 42 at or near the point of contact 44, thereby preventing the desired electrical contact between these two conductive pads.

A second conventional switch contact design is illustrated in FIG. 3. A computer key 48 comprises a switch contact 50 constituted by conductive traces 52 and 54 which are spaced on a printed circuit board 58 in an adjacent, but electrically isolated, manner and conductive layer 56 mounted underneath collapsible dome 60. When computer key 48 is depressed, dome 60 buckles and conductive layer 56 is brought into an electrical contact with both conductive traces 52 and 54, thereby electrically shorting traces 52 and 54. U.S. Pat. No. 4,677,268, U.S. Pat. No. 4,760,217, and U.S. Pat. No. 4,814,561 all disclose computer keys similar to that shown in FIG. 3 in which conductive material is mounted to the dome to constitute part of the switch contact. The disadvantage of this switch contact construction is that dome sheets having conductive material fixed in individual domes are more expensive than dome sheets without the conductive material. Accordingly, a computer keyboard which incorporates the switch contact of FIG. 3 is relatively more expensive.

This invention provides a low cost keyboard having a minimum number of components. This invention also provides improved and low cost switch contacts for a computer key structure which substantially reduce problems associated with contamination.

BRIEF DESCRIPTION OF THE DRAWINGS

One of more preferred embodiments is described with reference to the following accompanying drawings.

FIG. 4 is a diagrammatic cross-sectional view of a computer keyboard constructed according to this invention.

FIG. 5 is an exploded view of the FIG. 4 keyboard.

DETAILED DESCRIPTION OF THE PREFERRED EMBODIMENTS

Figure 1:
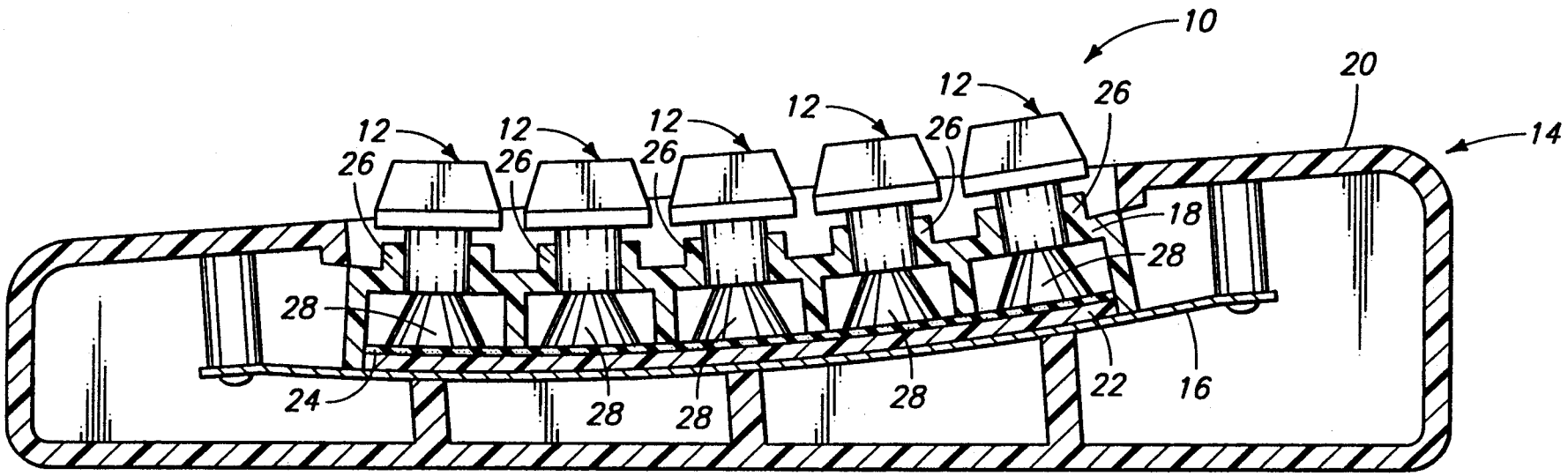
FIG 1 PRIOR ART
FIG. 1 is a cross-sectional view of a prior art computer keyboard.
Figure 2A:
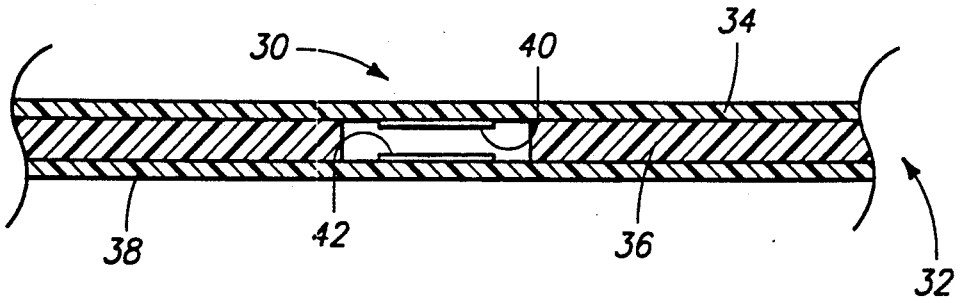
Fig 2A PRIOR ART
FIG. 2A is a cross-sectional view of a segment of a switch membrane illustrating a prior art switch contact in its rest position.
Figure 2B:
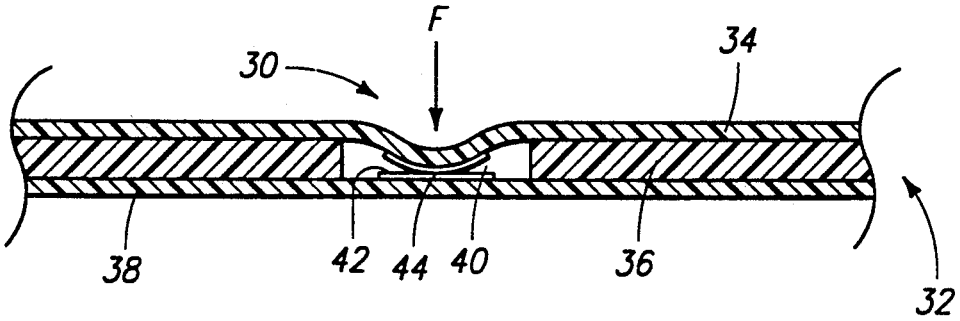
Fig 2B PRIOR ART
FIG. 2B is a cross-sectional view of the FIG. 2A switch membrane and illustrates the switch contact in its activated position.
Figure 3:
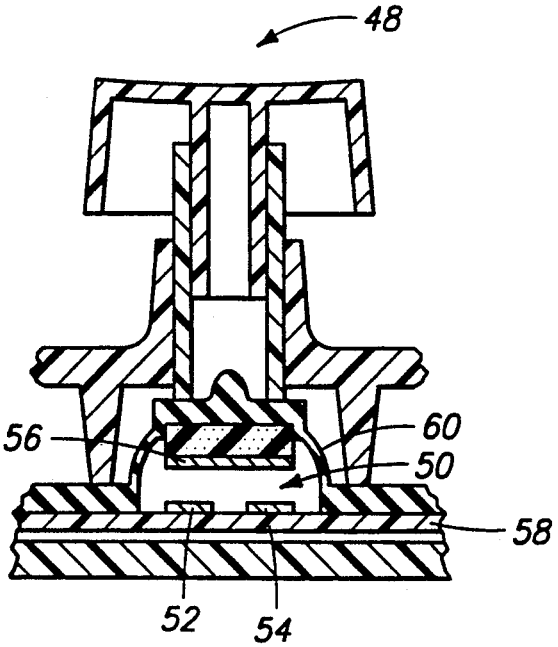
Fig 3 PRIOR ART
FIG. 3 is a cross-sectional view of a prior art computer key and illustrates another type of prior art switch contact.

This disclosure of the invention is submitted in furtherance of the constitutional purposes of the U.S. Patent Laws "to promote the progress of science and useful arts" (Article 1, Section 8).

FIGS. 4 and 5 diagrammatically illustrate a low cost computer keyboard 70 constructed according to this invention. Keyboard 70 comprises a monoblock 72 and computer keys 74, 76, 78, 80, and 82. Monoblock 72 is preferably formed of rigid plastic and constitutes a backing plate, a mounting plate, and a casing in one structure. This is advantageous over the prior art because this invention minimizes the number of structural components. Monoblock 72 has smooth and curving casing features to provide the aesthetic appearance of a finished keyboard.

Monoblock 72 has an upper surface 84 (FIG. 5) and multiple key support 86–90 protruding or extending upward from surface 84. Monoblock 72 has multiple annular recesses 92–96 around associated key supports 86–90. These recesses are discussed below in more detail.

Keyboard 70 has a switch membrane structure 98 disposed on top of monoblock surface 84. Switch membrane structure 98 has multiple apertures 100–104 sized to receive key supports 86–90 which extend through these apertures. Switch apertures 100–104 are preferably annular or substantially circular. Switch membrane 98 also has multiple switch contacts 300–304 positioned adjacent to the peripheries of respective apertures 100–104 for each computer key 74, 76, 78, 80, and 82. Preferably, switch contacts 300–304 are annular and positioned near peripheral edges of apertures 100–104 so that the switch contacts are positioned above associated recesses 92–96 in monoblock 72. Switch contacts 300–304 are discussed below in more detail with reference to FIGS. 9 and 10.

Keyboard 70 includes electronic circuitry 106, such as a microprocessor, buffer, or other logic circuits, mounted on one end of switch membrane 98. Mounting electronic circuitry 106 directly on switch membrane 98 eliminates an additional circuit board and thereby minimizes the number of components employed in keyboard 70. A component cover 108 is fitted and mounted to monoblock 72 beneath electronic circuitry 106 to define a chamber 110 in which electronic circuitry 106 is housed. Electronic circuitry 106 is protected within chamber 110 beneath a portion 107 of monoblock 72.

Electronic circuitry 106 is electrically coupled to switch contact 300–304 via switch membrane structure 98. Switch membrane structure 98 is preferably formed of a flexible insulative material, such as Mylar, having conductive traces patterned and formed thereon which interconnect switch contacts 300–304 with electronic circuitry 98. Alternatively, switch membrane 98 may comprise a printed circuit board or other circuit means for conveying signals from the electrical switch contacts to the circuitry.

Keyboard 70 has a dome sheet 110 positioned on top of switch membrane 98. Dome sheet 110 is formed of a resilient insulative material, such as rubber or an elastomeric material, which has multiple resilient and collapsible domes 112–116. Domes 112–116 are appropriately spaced on dome sheet 110 to align with corresponding switch membrane apertures 100–104 and corresponding key supports 86–90. Domes 112–116 have respective openings 118–122, which are preferably substantially circular, formed therein and are aligned concentrically with annular apertures 100–104. Dome openings 118–122 are sized larger than key supports 86–90 so that domes 112–116 can move downward along the outer surface of key supports 86–90 when the computer keys are depressed. Domes 112–116 are described below in more detail.

Keyboard 70 also comprises multiple key bodies 124–128 which are operatively mounted to corresponding key supports 86–90 of monoblock 72. Key bodies 124–128 include respective stems 130–134 which extend through corresponding dome openings 118–122 and slidably engage patterned grooves provided on the inner walls of corresponding key supports 86–90.

Figure 6:
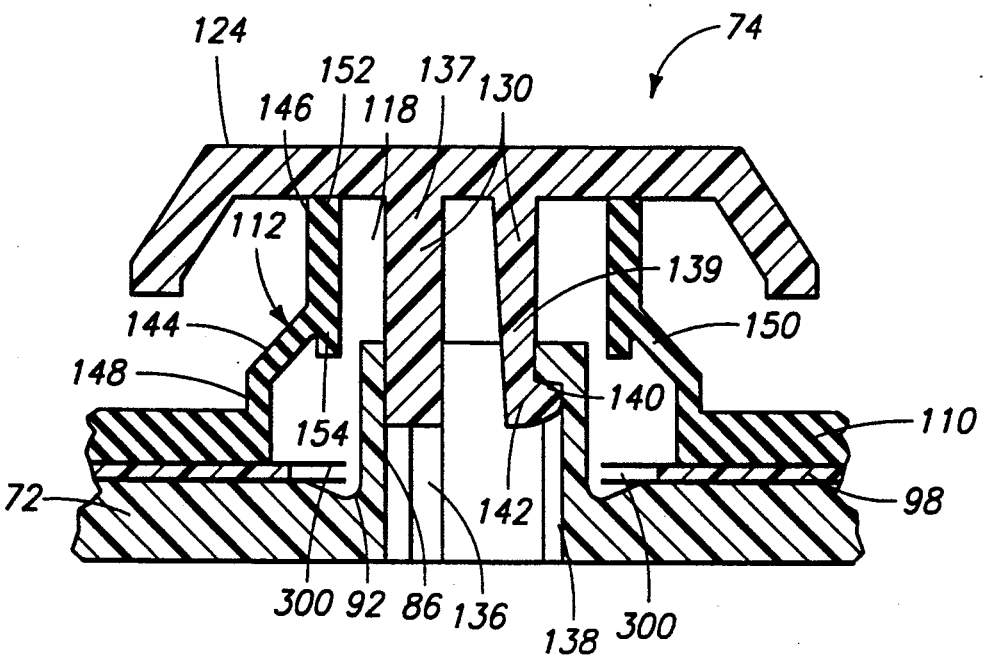
FIG. 6 is a diagrammatic cross-sectional view of a computer key incorporated in the FIG. 4 keyboard and is illustrated in its extended, rest position.
Figure 8:
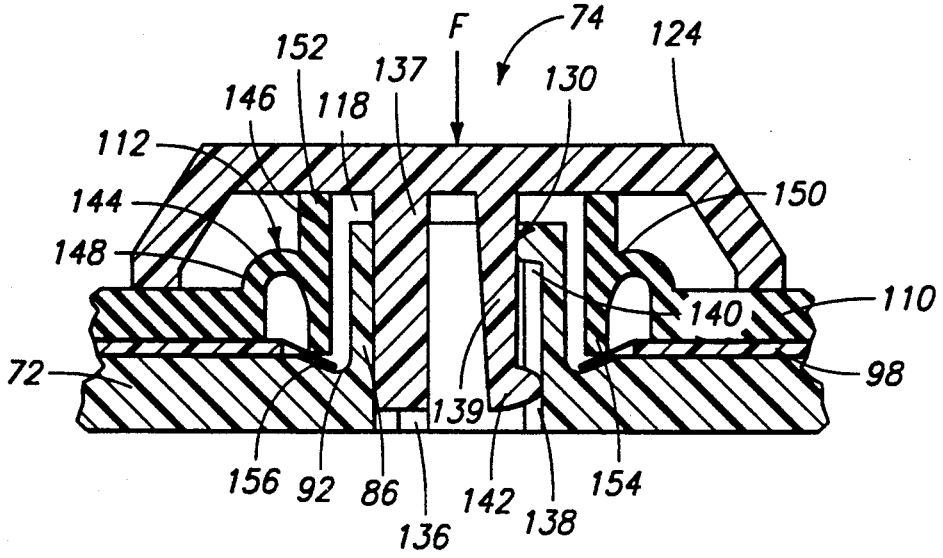
FIG. 8 is a diagrammatic cross-sectional view of the FIG. 6 computer key depicted in its depressed, activated position.

Upon application of a downward transverse force, key bodies 124–128 are movable within corresponding key supports 86–90 from extended, rest positions (as shown in FIGS. 4 and 6) through intermediate positions to depressed, activated positions (as shown, for example, in FIG. 8). Resilient domes 112–116 collapse or buckle as the key bodies are depressed and actuate respective switch contacts on switch membrane 98. When the downward force is removed, domes 112–116 rebound to their non-collapsed state to return respective key bodies 124–128 to their rest positions. The "spring-like" return function of resilient domes 112–116 effectively biases corresponding key bodies 124–128 to their rest positions.

As shown in FIG. 4, each computer key 74, 76, 78, 80, and 82 has associated with it a corresponding key support 86–90 of monoblock 72, a recess 92–96 in monoblock 72, a switch contact 300–304 on switch membrane 98, a resilient dome 112–116 and associated dome opening 118–122 of dome sheet 110, and a key body 124–128. The structure of an individual computer key is discussed in more detail below with reference to computer key 74 illustrated in FIGS. 6–8. The other computer keys of keyboard 70 have a similar structure, but will not be explained in detail. The same numbers are used throughout to reference like components.

Figure 7:
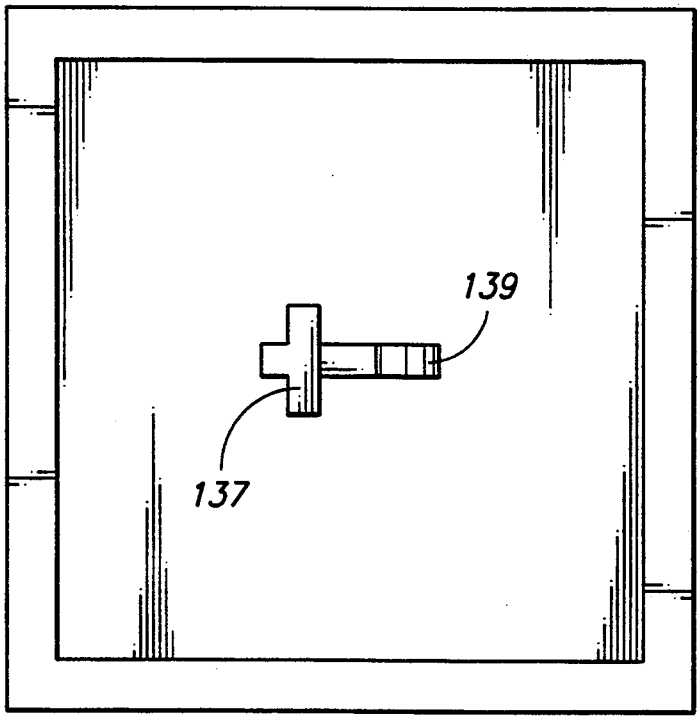
FIG. 7 is a bottom plan view of a key support portion of the FIG. 6 computer key.

In FIGS. 6–8, computer key 74 has key body 124 operatively mounted in key support 86. More particularly, key body 124 has key stems 130 which extend through dome opening 118 of dome 112. Preferably, stems 130 consist of a "T-shaped" guide stem 137 and fastening stem 139. Key support 86 has a complimentary "T-shaped" guide slot 136 formed in the interior thereof to receive guide stem 137. The "T-shaped" stem/slot arrangement allows vertical movement of key body 124 within key support 86, but prevents rotational movement of key body 124 about key support 86. Guide slot 136 preferably extends longitudinally all of the way through key support 86.

Key support 86 also has a guide and lock groove 138 formed in the inner surface thereof from the bottom of the key support to an engagement face 140. Fastening stem 139 has a protruding portion 142 with abuts engagement face 140 when key body 124 is at its extended, rest position to limit any farther upward travel by key body 124. During assembly, fastening stem 139 is deflected slightly as the guide stem 137 is initially inserted down into guide slot 136 and then springs back once portion 142 moves past engagement face 140 and into guide and lock groove 138. Thereafter, dome 112 maintains an upward biasing force against key body 124 and fastening stem 139 abuts engagement face 140 of groove 138 to counteract this force and hold the key body 124 in place. In this manner, key body 124 is quickly and easily installed by simply "snapping" it into key support 86.

Dome 112 comprises a frustoconical section 144 and a hollow cylindrical section 146. Cylindrical section 146 defines opening 118 which is diametrically large enough to slide over and around key support 86. Cylindrical section 146 has an upper end 152 which abuttingly supports key body 124 and a lower end 154. Frustoconical section 144 has a lower end 148 connected to, or integrally formed with, dome sheet 110 and an upper end 150 connected to, or integrally formed with, cylindrical section 146 between its upper and lower ends 152, 154. Accordingly, frustoconical section 144 suspends cylindrical section 144 at least partially elevationally above key support 86 as shown.

Frustoconical section 144 is designed to collapse or buckle when a transverse downward force F is applied to key body 124 as key body 124 is depressed to its activated position (FIG. 8). Lower end 154 of cylindrical section 146 engages switch contact 300 of switch membrane 98 and deflects it into recess 92 of monoblock 72 to actuate switch contact 300. Lower end 154 therefore constitutes a switch actuating means for actuating switch contact 300. Desired overtravel of computer key 74 is achieved by compression of cylindrical section 146 of dome 112 and by deflecting flexible switch membrane 98 into monoblock recess 92. Key body 124 stops against rubber or elastomer dome sheet 110. This results in a very quiet keystroke. Accordingly, by placing the dome sheet 110 directly beneath the key bodies, the present invention significantly reduces the noise problems encountered by prior art keyboards which experience a plastic-against-plastic collision caused by plastic key bodies striking against plastic enclosures or mounting plates.

Switch contact 156, and the actuation thereof, is discussed below in more detail with reference to FIGS. 9 and 10. Once the force F is removed, dome 112 springs back to its pre-buckled position to return key body 124 to its extended, rest position (FIG. 6).

The keyboard and computer key of this invention have numerous advantages over prior art keyboards. First, the present invention minimizes the number of components employed in a computer keyboard. Monoblock 72 simultaneously functions as the support plate, the mounting plate for computer keys, and the enclosure, thereby minimizing the number of structural components. This significantly reduces the cost of the keyboard in terms of component and manufacturing costs and in terms of assembly expenses. Second, placing the dome sheet 110 on top of switch membrane 98 and monoblock 72 protects the switch contacts 156 from contamination. The computer key illustrated in FIG. 6 is effectively enclosed to prevent any introduction of foreign debris or particles which could interfere with proper operation of the computer key. Third, placing dome sheet 110 beneath key body 124 significantly improves the "quietness" of the computer keyboard.

Figure 9:
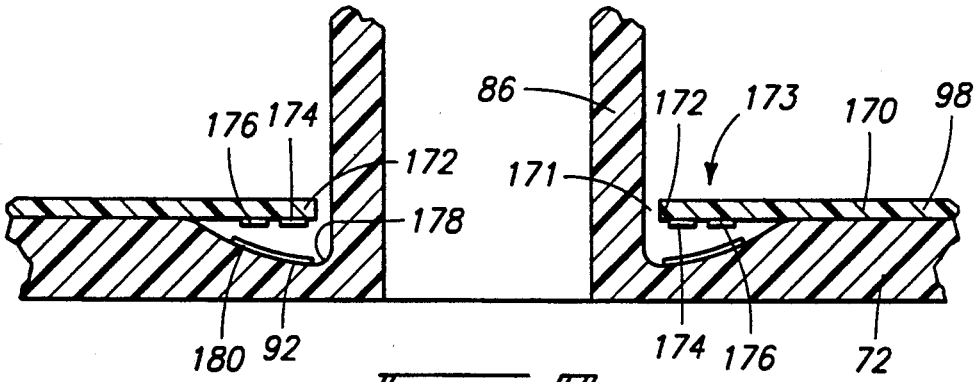
FIG. 9 is an enlarged diagrammatic cross-sectional view of one type of switch contact according to this invention.
Figure 10:
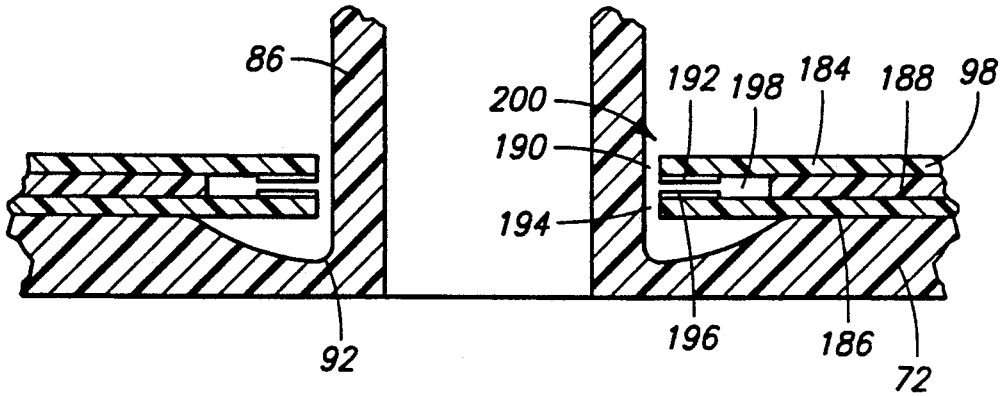
FIG. 10 is an enlarged diagrammatic cross-sectional view of another type of switch contact according to this invention.
Figure 11:
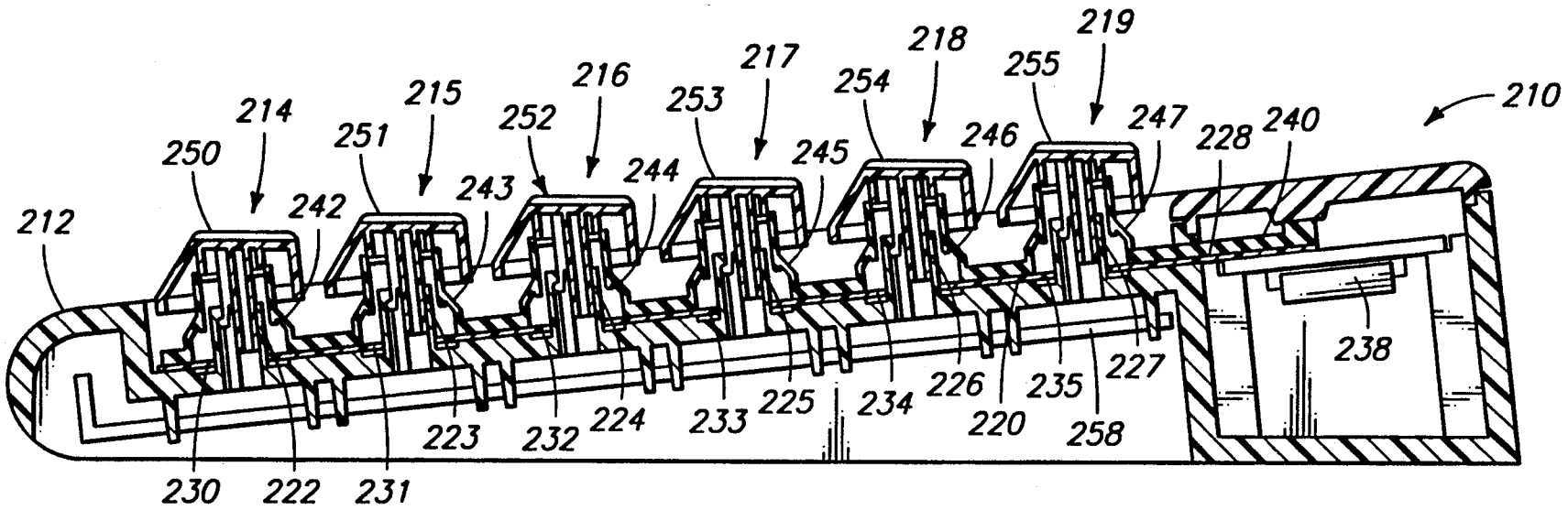

FIGS. 9 and 10 show two different embodiments of a switch contact for computer key 74 in accordance with this invention. In FIG. 9, switch membrane 98 comprises a flexible insulative layer 170, such as Mylar, with an annular aperture 171 (i.e., aperture 100 of FIG. 5) formed therein about key support 86. Flexible switch membrane 170 has a portion 172 which defines the periphery of aperture 171. Flexible layer 170 includes a first conductive trace 174 and a second conductive trace 176 formed on peripheral portion 172 of flexible layer 170 about annular aperture 171. First conductive trace 176 is positioned adjacent to, but electrically isolated from, second conductive trace 176.

First and second conductive traces 174, 176 are aligned above monoblock recess 92 which is also annular about the base of key support 86. Recess 92 has a surface 178 upon which a conductive material 180 is deposited. The conductive material is preferably conductive ink. Peripheral portion 172 of flexible switch membrane 170 extends from the surface of monoblock 72 above recess 92 such that first and second conductive traces 174, 176 are suspended above, but do not contact, conductive material 180 on recess surface 178. First and second conductive traces 174, 176 provided on flexible layer 170 and conductive material 180 constitute a switch contact 173.

When a user depresses the computer key body, annular lower switch actuating end 154 of dome cylindrical section 146 (FIG. 8) engages annular peripheral portion 172 of flexible layer 170 and deflects peripheral portion 172 into recess 92. First and second conductive traces 174, 176 are thereby forced into electrical contact with conductive material 180. As a result, first conductive trace 174 is electrically coupled to second conductive trace 176 to "close" switch contact 173. When the user releases the computer key, dome 112 returns key body 124 to its extended, rest position (FIG. 6) and peripheral portion 172 of flexible layer 170 rebounds to the position shown in FIG. 9 thereby "opening" switch contact 173.

One advantage to switch contact 173 of FIG. 9 is that only a single flexible membrane layer is employed. With this structure, component costs and assembly expenses are reduced.

In FIG. 10, switch membrane 98 comprises a first layer 184, a second layer 186, and a spacer layer 188. First and second layers 184 and 186 are preferably formed of flexible, insulative material, such as Mylar. First layer 184 has an annular first aperture 190 and a first conductive trace 192 formed about first aperture 190. Similarly, second layer 186 has an annular second aperture 194 and a second conductive trace 196 formed about second aperture 194. First and second conductive traces 192, 196 are aligned adjacent to, and facing one another, in close actuating proximity above recess 92.

Spacer layer 188 is provided between first and second layer 184, 186 to separate first and second conductive traces 192, 196. Spacer layer 188 has an annular aperture 198 with a diameter larger than the diameters of first and second apertures 190 and 194. In this manner, spacer layer 188 creates an insulating air gap between first and second conductive traces 192, 196 which may be overcome when the computer key is depressed. Apertures 190, 194, and 198 constitute switch membrane aperture 100 shown in FIG. 5.

When a user depresses key body 124 of computer key 74, lower switch actuating end 154 of dome cylindrical section 146 engages upper layer 184 and forces first conductive trace 192 into electrical contact with second conductive trace 196. First and second conductive traces 192, 196 thereby constitute a switch contact 200 which is "closed" as the key body is depressed. After this initial engagement, the contacting first and second conductive traces 194, 196 are deflected (i.e., the flexible layers 184, 186 are bent) into recess 92 of monoblock 72. As the conductive traces of switch contact 200 flex together into recess 92, first conductive trace 192 moves relative to second conductive trace 196 creating a surface friction therebetween. This relative sliding motion effectively wipes or cleans the contact surfaces of conductive traces 192, 196 each time the computer key 74 is used. This "self-cleaning" technique improves switch operability in comparison to the prior art single-point switch contacts which can become contaminated with foreign particles or debris at the single point of contact.

The switch contacts shown in FIGS. 9 and 10 are advantageous over prior art switch contacts in that the annular or substantially circular construction of each switch contact provides multiple contact points in comparison to the single-point contact structure of prior art switch contacts. Problems associated with switch contamination are effectively reduced or completely eliminated. Another favorable consequence of having multiple electrical contact points is that proportionally less force can be applied in comparison to single-point switch contacts to ensure adequate electrical contact.

Figure 11:
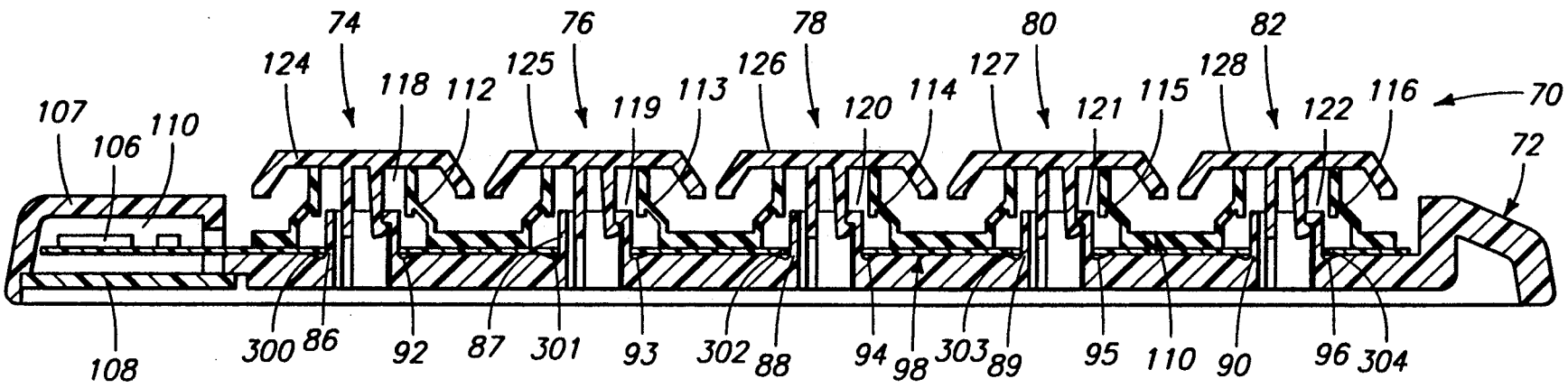
FIG. 11 is a diagrammatic cross-sectional view of a computer keyboard according to a second embodiment of this invention.
Figure 11:
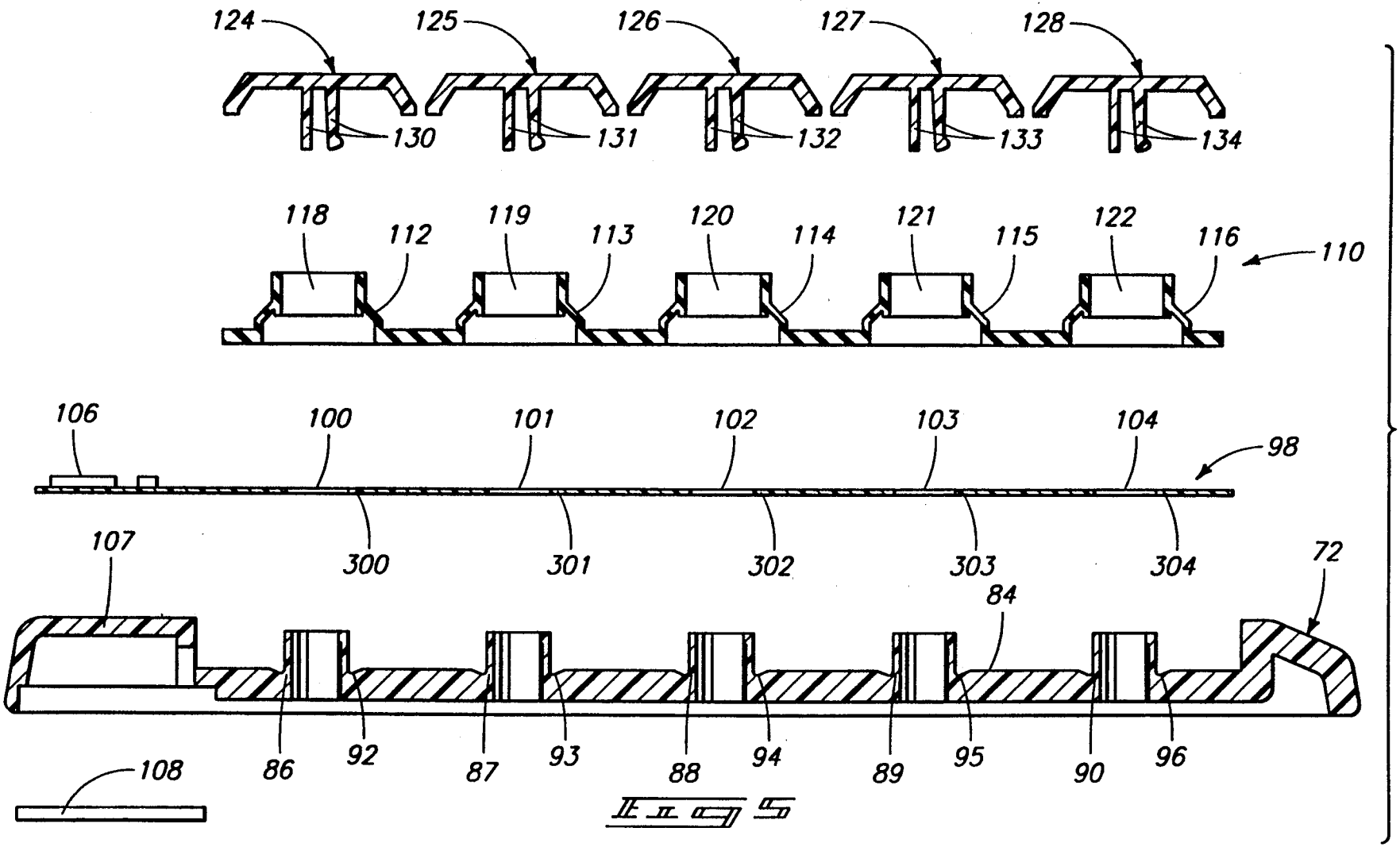

FIGS. 11-15 illustrate a second embodiment of a computer keyboard and computer key constructed according to this invention. In FIG. 11, computer keyboard 210 comprises monoblock 212 and multiple computer keys 214-219 operatively mounted to monoblock 212. Monoblock 212 is preferably an integral molded, rigid plastic component having an upper support surface 220 and multiple key supports 222-227 protruding upward from surface 220. A switch membrane 228 is positioned on top of monoblock 212 and includes multiple annular switch contacts 230-235 disposed about corresponding key supports 222-227 which are electrically coupled to microprocessor 238.

Keyboard 210 has a dome sheet 240 mounted on top of switch membrane 228. Dome sheet 240 includes multiple resilient domes 242-247 provided for corresponding computer keys 214-219. Domes 242-247 each have a dome opening suitable to receive corresponding key supports 222-227 such that the domes slide down around respective key supports when the computer keys are depressed.

Computer keyboard 210 also includes multiple key bodies 250-255 which are operatively mounted to corresponding key supports 222-227 of monoblock 212. Key bodies 250-255 have key stems which extend through dome openings of corresponding domes 242-247 to slidably engage key supports 222-227.

Computer keyboard 210 may also include a rigid metal or plastic backing plate 258 mounted on the underside of monoblock 212 beneath computer keys 214-219. This backing plate 258 is entirely optional, but can be added for those situations in which additional rigidity, weight, and/or electrical shielding is desired by the ultimate user.

Each computer key 214-219 of keyboard 210 has associated with it one key support 222-227, one switch contact 230-235, one dome 242-247, and one key body 250-255. The specific structure of a computer key according to this second aspect of this invention will be described with reference to computer key 214 which is exemplary of other computer keys incorporated in keyboard 210. A detailed discussion of computer key 214 is provided with reference to FIGS. 12-14.

Each key support 222 extends upwardly from monoblock 212 along a respective vertical longitudinal axis 264. Switch contact 230 is disposed around key support 222 above annular monoblock recess 290. Switch contact 230 is illustrated as the switch contact described above with reference to FIG. 10. Alternatively, the switch contact discussed with reference to FIG. 9 can also be used.

Dome 242 comprises a frustoconical section 260 and a hollow cylindrical section 262 which are centered on axis 264. Cylindrical section 262 has a lower end 270 positioned around key support 222 and an upper end 272. Frustoconical section 260 has a lower end 266 integrally formed with, or connected to, dome sheet 240 and an upper end 268 integrally formed with, or connected to, cylindrical section 262 between its upper and lower ends 270, 272. Frustoconical section 260 suspends cylindrical 262 at least partially above key support 222 as shown. Cylindrical section 262 further includes an annular flange 274 which extends radially inward toward axis 264 at upper end 272. The purpose of flange 274 is described below.

Key body 250 comprises a cap 276 with an upper surface 278 formed for engagement by a user's finger tip, a lower surface 280, and side walls 282 which extend downwardly and around cylindrical section 262 of dome 242 in an umbrella-like fashion. Key body 250 also has members 284 protruding downward from lower surface 280 which abut annular flange 274 of cylindrical section 262. Key body 250 further includes a guide stem 286 and a fastening stem 288 which extends through cylindrical section 262 of dome 242 to slidably mount within key support 222. Guide stem 286 provides vertical movement of key body 250 within key support 222 while preventing rotation of key body 250 relative to key support 222. Fastening stem 288 locks key body 250 into key support 222.

Figure 12:
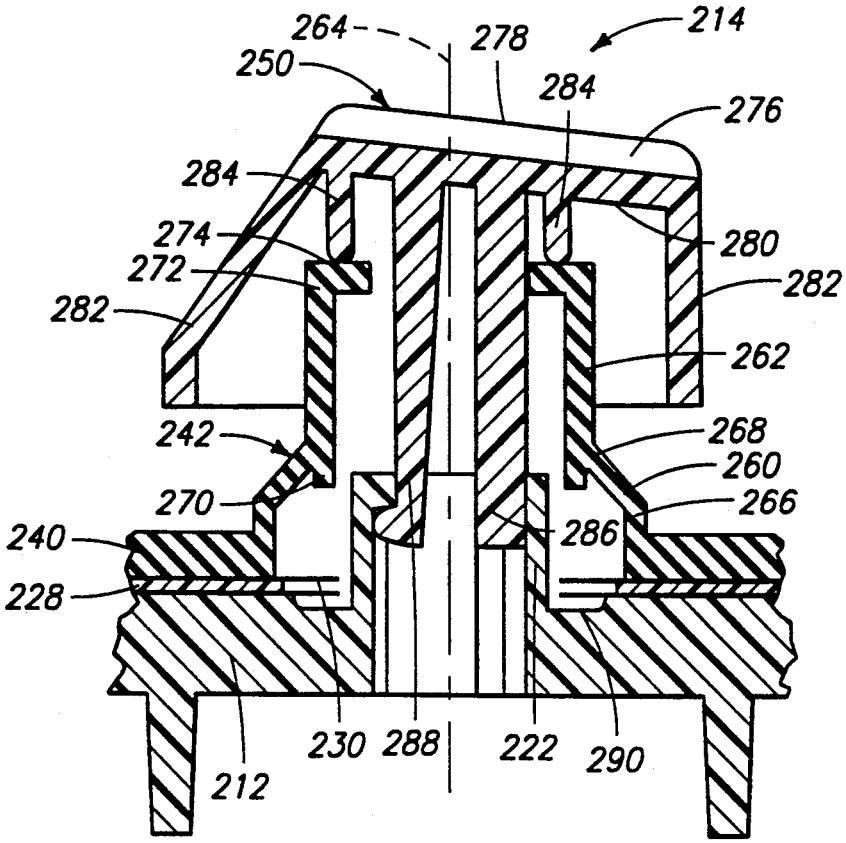
FIG. 12 is a diagrammatic cross-sectional view of a computer key incorporated in the FIG. 11 keyboard and is illustrated in its extended, rest position.

The operation of computer key 214 is described with reference to FIGS. 12–14. In FIG. 12, key body 250 is at its extended, rest position. Resilient dome 242 biases key body 250 to this position.

Figure 13:
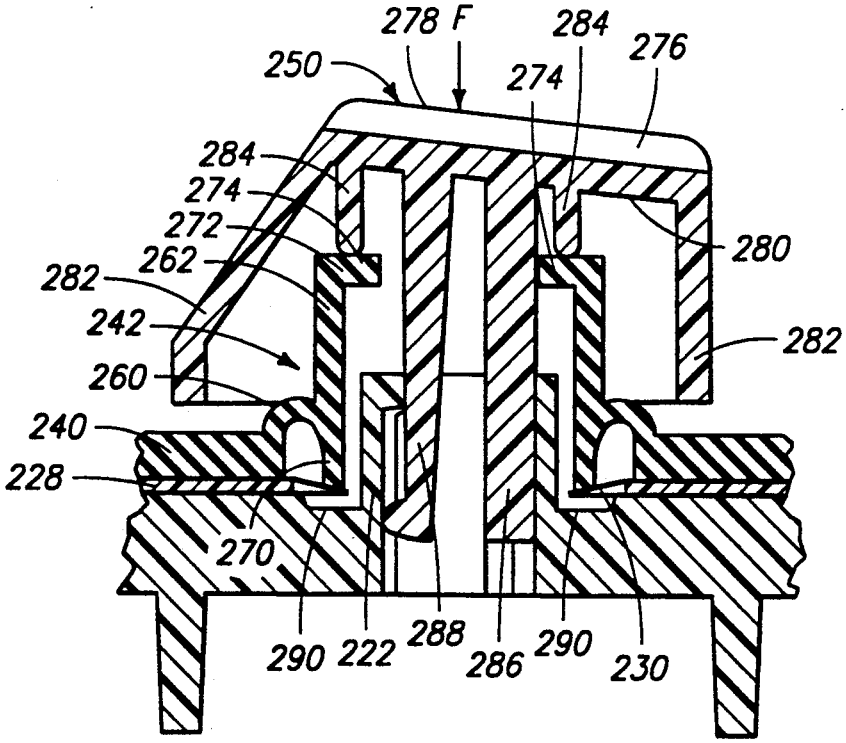
FIG. 13 is a diagrammatic cross-sectional view of the FIG. 12 computer key depicted in its intermediate position.
Figure 14:
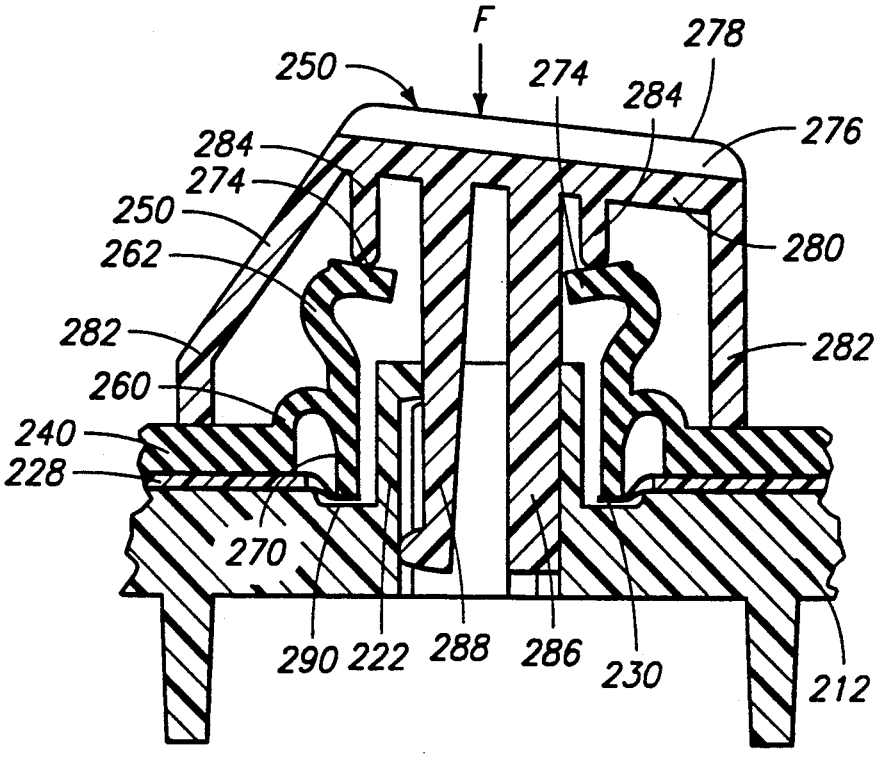
FIG. 14 is a diagrammatic cross-sectional view of the FIG. 12 computer key depicted in its depressed, activated position.

In FIG. 13, a downward transverse force F is applied to key body 250 to depress key body 250 to an intermediate switch contact position in which lower end 270 of cylindrical section 262 of dome 242 engages and actuates switch contact 230 of switch membrane 228. As key body 250 is depressed to the intermediate position, frustoconical section 260 is designed to bow or buckle to permit the downward movement of key body 250 and cylindrical section 262. Guide stem 286 guides key body 250 downward through key support 222 while preventing angular rotation of key body 250 about key support 222.

As key body 250 is depressed beyond its intermediate position, cylindrical section 262 of dome 242 deflects switch contact 230 of switch membrane 228 into recess 290. Once switch contact 230 engages or "bottoms out" against recess 290, cylindrical section 262 is designed to buckle as illustrated in FIG. 14. Members 284 of key body 250 push against flange 274 to initiate the buckling of cylindrical section 262. Flange 274 functions as a lever which transfers the downward force about the right angle elbow formed by flange 274 and cylindrical section 262 to initiate the outward bowing of cylindrical section 262.

This "double-buckling" provides appropriate computer key overtravel which is important to assure switch contact and to reduce operator fatigue. The wall thicknesses of frustoconical section 260 and cylindrical section 262 may be configured to provide the desired "feel" and the appropriate buckling sequence (i.e., the frustoconical section buckles before the cylindrical section) as the force of contact is a function of wall thickness.

This embodiment of the invention has the same advantages as those discussed previously with respect to the first embodiment. Keyboard 210 employs a minimum number of components because monoblock 212 functions simultaneously as a support plate, a mounting plate, and an enclosure or casing. Additionally, keyboard 210 is relatively quiet because side walls 282 of key body 250 strike against rubber or elastomer dome sheet 240 (FIG. 14) resulting in a muffled and quiet sound.

In compliance with the statute, the invention has been described in language more or less specific as to methodical features. It is to be understood, however, that the invention is not limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

We claim:

1. A computer keyboard comprising:

a monoblock having an upper surface and a plurality of key supports protruding upward from the surface;

a switch membrane disposed on the monoblock upper surface, the switch membrane having a plurality of associated apertures and switch contacts for corresponding key supports, the switch contacts positioned adjacent to associated apertures, the key supports of the monoblock extending through corresponding apertures;

the switch membrane having a flexible layer with annular apertures formed therein, the flexible layer having first and second conductive traces formed thereon adjacent to, but isolated from, one another about the annular apertures;

the monoblock having annular recesses formed around the key supports beneath associated first and second conductive traces, the recesses having surfaces, the monoblock also having a conductive material provided on the recess surfaces;

multiple key bodies operatively mounted in corresponding key supports of the monoblock, the key bodies having respective stems which are movably supported by corresponding key supports;

the key bodies being movable within the corresponding key supports from extended rest positions through intermediate positions to depressed activated positions;

a dome sheet positioned intermediate of the switch membrane and the multiple key bodies, the dome sheet having a plurality of resilient domes for corresponding key bodies for biasing the key bodies to the extended rest positions;

the domes having openings formed therein to provide access for the stems of the key bodies to the corresponding key supports; and the domes having switch actuating means for actuating respective switch contacts of the switch membrane upon depression of the key bodies to the depressed activated positions, the dome switch actuating means deflecting the flexible layer into the monoblock recesses and forcing the first and second conductive traces of the flexible layer into electrical contact with the conductive material on the associated recess surfaces to electrically short the first and second conductive traces through the conductive material as the corresponding key bodies are depressed.

2. A computer keyboard according to claim 1 further comprising electronic circuitry mounted on the switch membrane and coupled to the switch contacts of the switch membrane.

3. A computer keyboard comprising:

a monoblock having an upper surface and a plurality of key supports protruding from the surface, the monoblock also having a plurality of recesses in the surface about associated key supports;

a flexible switch membrane disposed on the monoblock upper surface, the flexible switch membrane having a plurality of associated apertures and switch contacts for corresponding key supports, the key supports of the monoblock extending through corresponding apertures, the switch contacts positioned adjacent to corresponding apertures above the recesses in the monoblock;

multiple key bodies operatively mounted in corresponding key supports of the monoblock;

a dome sheet positioned intermediate the switch membrane and the key bodies, the dome sheet having a plurality of resilient domes for corresponding key bodies, the domes having openings formed therein to provide access for the key bodies to the corresponding key supports;

at least one key body being associated with one dome, one dome opening, one switch contact, one key support, and one recess;

the one key body having a stem which extends through the one dome opening to slidably mount to the one key support, the one key body being movable within the one key support from an extended rest position through an intermediate position to a depressed activated position, the one dome biasing the one key body to the rest position; and the one dome having a frustoconical section with upper and lower ends and a hollow cylindrical section with an upper end and a lower switch actuating end, the lower end of the frustoconical section being connected to the dome sheet and the upper end of the frustoconical section being connected to the cylindrical section between the upper end and the lower switch actuating end of the cylindrical section, the frustoconical section being adapted to buckle as the one key body is depressed to the intermediate position causing the lower switch actuating end of the cylindrical section to engage and actuate the one switch contact, the cylindrical section being adapted to buckle as the one key body is depressed beyond the intermediate position.

4. A computer keyboard according to claim 3 wherein:

the cylindrical section of the one dome is aligned along an axis and has a flange at the upper end thereof extending radially inward toward the axis;

the one key body has a cap with an upper surface for engagement by a user and a lower surface, the one key body having members protruding from the lower surface to abut the flange of the cylindrical section; and the members of the one key body pushing against the flange of the cylindrical section to initiate buckling of the cylindrical section as the one key body is depressed beyond the intermediate position.

5. A computer keyboard comprising:

a monoblock having an upper surface and a plurality of key supports protruding from the surface, the monoblock also having a plurality of recesses in the surface about associated key supports;

a flexible switch membrane disposed on the monoblock upper surface, the flexible switch membrane having a plurality of associated apertures and switch contacts for corresponding key supports, the key supports of the monoblock extending through corresponding apertures, the switch contacts positioned adjacent to corresponding apertures above the recesses in the monoblock;

multiple key bodies operatively mounted in corresponding key supports of the monoblock;

a dome sheet positioned intermediate the switch membrane and the key bodies, the dome sheet having a plurality of resilient domes for corresponding key bodies, the domes having openings formed therein to provide access for the key bodies to the corresponding key supports;

at least one key body being associated with one dome, one dome opening, one switch contact, one key support, and one recess;

the one key body having a stem which extends through the one dome opening to slidably mount to the one key support, the one key body being movable within the one key support from an extended rest position through an intermediate position to a depressed activated position, the one dome biasing the one key body to the rest position;

the one recess has a recess surface;

the one switch contact comprises:

first and second conductive traces formed on a flexible insulative layer adjacent to, but isolated from, one another;

a conductive material provided on the recess surface; and the one dome having switch actuating means for actuating the one switch contact upon depression of the one key body to the depressed activated position, the dome switch actuating means deflecting the flexible layer into the one recess and forcing the first and second conductive traces into electrical contact with the conductive material on the recess surface to electrically short the first and second conductive traces through the conductive material as the one key body is depressed.

6. A computer keyboard comprising:

a monoblock having an upper surface and a plurality of key supports protruding from the surface, the monoblock also having a plurality of recesses in the surface about associated key supports;

a flexible switch membrane disposed on the monoblock upper surface, the flexible switch membrane having a plurality of associated apertures and switch contacts for corresponding key supports, the key supports of the monoblock extending through corresponding apertures, the switch contacts positioned adjacent to corresponding apertures above the recesses in the monoblock;

multiple key bodies operatively mounted in corresponding key supports of the monoblock;

a dome sheet positioned intermediate the switch membrane and the key bodies, the dome sheet having a plurality of resilient domes for corresponding key bodies, the domes having openings formed therein to provide access for the key bodies to the corresponding key supports;

at least one key body being associated with one dome, one dome opening, one switch contact, one key support, and one recess;

the one key body having a stem which extends through the one dome opening to slidably mount to the one key support, the one key body being movable within the one key support from an extended rest position through an intermediate position to a depressed activated position, the one dome biasing the one key body to the rest position;

the one switch contact comprising:

a first conductive trace;

a second conductive trace adjacent to, but spaced from, the first conductive trace; and the one dome having a frustoconical section with upper and lower ends and a hollow cylindrical section with an upper end and a lower switch actuating end, the lower end of the frustoconical section being connected to the dome sheet and the upper end of the frustoconical section being connected to the cylindrical section between the upper end and lower switch actuating end of the cylindrical section to suspend the cylindrical section at least partially elevationally above the one key support, the frustoconical section being adapted to buckle as the one key body is depressed to the intermediate position causing the lower switch actuating end of the cylindrical section to (a) force the first conductive trace into electrical contact with the second conductive trace and (b) deflecting the contacting first and second conductive traces into the one recess, the cylindrical section being adapted to buckle as the one key body is depressed beyond the intermediate position.

7. A computer keyboard comprising:

a monoblock having an upper surface and a plurality of key supports protruding from the surface, the monoblock also having a plurality of recesses in the surface about associated key supports;

a flexible switch membrane disposed on the monoblock upper surface, the flexible switch membrane having a plurality of associated apertures and switch contacts for corresponding key supports, the key supports of the monoblock extending through corresponding apertures, the switch contacts positioned adjacent to corresponding apertures above the recesses in the monoblock;

multiple key bodies operatively mounted in corresponding key supports of the monoblock;

a dome sheet positioned intermediate the switch membrane and the key bodies, the dome sheet having a plurality of resilient domes for corresponding key bodies, the domes having openings formed therein to provide access for the key bodies to the corresponding key supports;

at least one key body being associated with one dome, one dome opening, one switch contact, one key support, and one recess;

the one key body having a stem which extends through the one dome opening to slidably mount to the one key support, the one key body being movable within the one key support from an extended rest position through an intermediate position to a depressed activated position, the one dome biasing the one key body to the rest position;

the one recess has a recess surface;

the one switch contact comprises:

first and second conductive traces formed on a flexible insulative layer adjacent to, but isolated from, one another;

a conductive material provided on the recess surface; and the one dome having a frustoconical section with upper and lower ends and a hollow cylindrical section with an upper end and a lower switch actuating end, the lower end of the frustoconical section being connected to the dome sheet and the upper end of the frustoconical section being connected to the cylindrical section between the upper end and the lower switch actuating end of the cylindrical section to suspend the cylindrical section at least partially elevationally above the one key support, the frustoconical section being adapted to buckle as the one key body is depressed to the intermediate position causing the lower switch actuating end of the cylindrical section to deflect the flexible layer into the one recess and force the first and second conductive traces into electrical contact with the conductive material on the recess surface to electrically short the first and second conductive traces through the conductive material, the cylindrical section being adapted to buckle as the one key body is depressed beyond the intermediate position.

8. A computer keyboard comprising:

a monoblock having a surface and a plurality of key supports protruding from the surface;

a switch membrane disposed on top of the monoblock surface, the switch membrane having a plurality of annular apertures and associated annular switch contacts about the annular apertures for corresponding key supports, the key supports of the monoblock extending through corresponding annular apertures;

multiple key bodies operatively mounted in corresponding key supports of the monoblock;

a dome sheet positioned intermediate the switch membrane and the key bodies, the dome sheet having a plurality of resilient domes for corresponding key bodies;

at least one key body being associated with one dome, one switch contact, and one key support;

the one dome having a frustoconical section with upper and lower ends and a hollow cylindrical section with an upper end and a lower switch actuating end, the lower end of the frustoconical section being connected to the dome sheet and the upper end of the frustoconical section being connected to the cylindrical section between the upper end and the lower switch actuating end of the cylindrical section to suspend the cylindrical section at least partially elevationally above the one key support;

the one key body having a stem which extends through the cylindrical section of the one dome to slidably mount to the one key support, the one key body being movable within the one key support from an extended rest position through an intermediate position to a depressed activated position, the one dome biasing the one key body to the rest position, a frustoconical section of the one dome being adapted to buckle as the one key body is depressed to the intermediate position causing the lower switch actuating end of the cylindrical section to engage and actuate the one switch contact, the cylindrical section being adapted to buckle as the one key body is depressed beyond the intermediate position.

9. A computer keyboard according to claim 8 wherein:

the switch membrane comprises:

a first flexible contact layer having first annular apertures and first conductive traces formed thereon about the first annular apertures;

a second flexible contact layer having second annular apertures and second conductive traces formed thereon about the annular second apertures, the second conductive traces being aligned adjacent to, and facing, the first conductive traces; and a spacer layer provided between the first and second contact layers to separate the first and second conductive traces, the spacer layer having apertures which are larger than the first and second apertures to allow the first and second conductive traces to be moved into electrical contact; and the monoblock has annular recesses formed around the key supports beneath associated first and second conductive traces;

at least one monoblock recess, one first conductive trace, and one second conductive trace being associated with the one key body and the one dome; and the lower switch actuating end of the cylindrical section of the one dome (a) forcing the one first conductive trace into contact with the one second conductive trace and (b) deflecting the contacting one first and second conductive traces into the one monoblock recess as the one key body is depressed to the intermediate position.

10. A computer keyboard according to claim 8 wherein:

the switch membrane comprises a layer of flexible material having first and second conductive traces formed thereon about the annular apertures, individual first conductive traces being disposed adjacent to, but isolated from, individual second conductive traces;

the monoblock has annular recesses formed around the key supports beneath associated first and second conductive traces, individual recesses having a surface, the monoblock also having a conductive material provided on the recess surfaces;

at least one monoblock recess and associated one recess surface, one first conductive trace, and one second conductive trace being associated with the one key body and the one dome; and the lower switch actuating end of the cylindrical section of the one dome deflecting the flexible layer into the one monoblock recess and forcing the one first and second conductive traces of the flexible layer into electrical contact with the conductive material on the one recess surface to electrically short the one first and second conductive traces through the conductive material as the one key body is depressed to the intermediate position.

11. A key for a computer keyboard comprising:

a key support protruding from a monoblock along an axis;

a switch contact positioned on top of the monoblock;

a resilient dome having a frustoconical section with upper and lower ends aligned along the axis and a hollow cylindrical section with upper and lower ends aligned along the axis, the lower end of the frustoconical section being positioned on top of the switch contact and the upper end of the frustoconical section being connected to the cylindrical section between the upper and lower ends of the cylindrical section to suspend the cylindrical section at least partially elevationally above the key support;

a key body having a stem which extends through the cylindrical section of the dome to slidably mount to the key support, the key body being movable within the key support from an extended rest position through an intermediate position to a depressed activated position, the resilient dome biasing the key body to the rest position;

the frustoconical section of the dome being adapted to buckle as the key body is depressed to the intermediate position causing the lower end of the cylindrical section to engage and actuate the switch contact, the cylindrical section being adapted to buckle as the key body is depressed beyond the intermediate position.

12. A key for a computer keyboard according to claim 11 wherein:

the cylindrical section of the dome has a flange extending radially inward toward the axis at the upper end of the cylindrical section;

the key body has a cap with an upper surface for engagement by a user and a lower surface, the key body having members protruding from the lower surface and abutting the flange of the cylindrical section; and the members pushing against the flange as the key body is depressed to initiate buckling of the cylindrical section as the key body is depressed beyond the intermediate position.

13. A key for a computer keyboard according to claim 11 wherein:

the switch contact comprises:

a first conductive trace;

a second conductive trace aligned adjacent to, but spaced from, the first conductive trace;

the cylindrical section of the dome forcing the first conductive trace into electrical contact with the second conductive trace when the key body is depressed to the intermediate position.

14. A key for a computer keyboard according to claim 11 wherein:

the monoblock has a recess around the key support, the recess having a surface; and the switch contact comprises:

first and second conductive traces formed on a flexible insulative layer adjacent to, but isolated from, one another;

a conductive material provided on the recess surface; and the cylindrical section of the dome deflecting the flexible layer into the recess and forcing the first and second conductive traces into electrical contact with the conductive material on the recess surface to electrically short the first and second conductive traces through the conductive material as the key body is depressed.

* * * * *